US011037723B2

(12) United States Patent
Dong et al.

(10) Patent No.: US 11,037,723 B2
(45) Date of Patent: Jun. 15, 2021

(54) TRANSFORMER

(71) Applicant: Delta Electronics, Inc., Taoyuan (CN)

(72) Inventors: Jianxing Dong, Taoyuan (CN); Jianping Ying, Taoyuan (CN); Teng Liu, Taoyuan (CN)

(73) Assignee: Delta Electronics, Inc., Taoyuan (TW)

( * ) Notice: Subject to any disclaimer, the term of this patent is extended or adjusted under 35 U.S.C. 154(b) by 204 days.

(21) Appl. No.: 15/876,272

(22) Filed: Jan. 22, 2018

(65) Prior Publication Data

US 2018/0323006 A1 Nov. 8, 2018

(30) Foreign Application Priority Data

May 8, 2017 (CN) ..... 201710317196.0

(51) Int. Cl.

| | |
|---|---|
| ***H01F 30/16*** | (2006.01) |
| ***H01F 27/32*** | (2006.01) |
| ***H01F 27/28*** | (2006.01) |
| ***H01F 27/24*** | (2006.01) |

(52) U.S. Cl.

CPC ..... *H01F 27/325* (2013.01); *H01F 27/24* (2013.01); *H01F 27/2828* (2013.01); *H01F 27/2895* (2013.01); *H01F 30/16* (2013.01); *H01F 2027/329* (2013.01)

(58) Field of Classification Search

CPC ..... H01F 24/427; H01F 38/28; H01F 38/34; H01F 27/34; H01F 27/2823; H01F 27/24; H01F 27/325; H01F 27/2828

USPC ..... 336/173, 174, 175

See application file for complete search history.

(56) References Cited

U.S. PATENT DOCUMENTS 2,920,297 A * 1/1960 Spicer ..... H01F 38/30 336/174
2,950,339 A * 8/1960 Mercier ..... H01F 38/30 174/102 R
3,398,004 A * 8/1968 Pendleton ..... C03C 8/14 335/299
4,295,112 A 10/1981 Yamada et al.

(Continued)

FOREIGN PATENT DOCUMENTS

CN 1223750 A 7/1999
CN 1418313 A 5/2003

(Continued)

OTHER PUBLICATIONS

The CN1OA dated Feb. 28, 2020 by the CNIPA.

(Continued)

*Primary Examiner* — Tszfung J Chan
(74) *Attorney, Agent, or Firm* — Qinghong Xu

(57) ABSTRACT

A transformer includes a magnetic core, a first winding and at least one second winding. The magnetic core has a window through which the first winding passes through without contacting the magnetic core. The second winding passes through the window of the magnetic core and is wound on the magnetic core. The second winding has a distance from the first winding, and a semi-conductive part is disposed between the second winding and the magnetic core. The present disclosure can effectively lower the risk of partial discharge between the second winding and the magnetic core, and thus the transformer of the present disclosure has high reliability.

12 Claims, 7 Drawing Sheets

(56) References Cited

U.S. PATENT DOCUMENTS

| | | | | | |
|---|---|---|---|---|---|
| 4,623,865 | A * | 11/1986 | Kiesel | H01F 27/027 | 336/174 |
| 5,307,040 | A * | 4/1994 | Lytollis | H01F 27/02 | 336/174 |
| 5,892,420 | A * | 4/1999 | Larranaga | H01H 71/125 | 335/18 |
| 6,337,616 | B1 * | 1/2002 | Sato | H01F 38/12 | 336/234 |
| 7,471,181 | B1 * | 12/2008 | MacLennan | H01F 3/14 | 336/229 |
| 2002/0121948 | A1 | 9/2002 | Giday et al. | | |
| 2004/0085171 | A1 * | 5/2004 | Cern | H03H 7/0138 | 336/174 |
| 2009/0289755 | A1 * | 11/2009 | Yu | H01F 27/36 | 336/84 R |
| 2011/0279207 | A1 * | 11/2011 | Patel | G01R 15/181 | 336/65 |
| 2015/0028989 | A1 * | 1/2015 | De Leon | H01F 27/306 | 336/84 C |

FOREIGN PATENT DOCUMENTS

| | | | | | |
|---|---|---|---|---|---|
| CN | 200944348 | Y | | 9/2007 | |
| CN | 201130597 | Y | | 10/2008 | |
| CN | 202473487 | U | * | 10/2012 | |
| CN | 202473487 | U | | 10/2012 | |
| CN | 103474217 | A | | 12/2013 | |
| CN | 104064343 | A | | 9/2014 | |
| CN | 105098998 | A | | 11/2015 | |
| CN | 106230304 | A | | 12/2016 | |
| JP | S60182709 | A | | 9/1985 | |
| JP | H04242910 | A | | 8/1992 | |
| WO | WO-2011161129 | A1 | * | 12/2011 | H01F 38/30 |

OTHER PUBLICATIONS

The 1st Office Action dated Feb. 25, 2020 by the CNIPA from application No. 201710318204.3.
The 2nd Office Action dated Sep. 10, 2020 by the CNIPA from application No. 201710318204.3.
The Final OA dated Dec. 30, 2020 by the USPTO from U.S. Appl. No. 15/876,424.

* cited by examiner

TRANSFORMER

CROSS REFERENCE

This application is based upon and claims priority to Chinese Patent Application No. 201710317196.0, filed on May 8, 2017, the entire contents thereof are incorporated herein by reference.

TECHNICAL FIELD

The present disclosure relates to a transformer.

BACKGROUND

MVD, SVG and other medium or high voltage systems can include hundreds of magnetic components such as magnetic-ring transformers which may occupy a considerable proportion of volume, weight and loss of the respective system. Modern industry has placed higher requirements on power density of the system. It is desirable that the system has a smaller volume, a higher power density and reliability. However, reducing volume of the transformer poses challenge on reliability of the system. Partial discharge tends to be generated between parts of the transformer. Mixture of ozone generated by the partial discharge and moisture in the air has a strong corrosive effect on insulating material, thus affecting safety and reliability of the transformer and even the entire system.

At present, in order to control partial discharge of the transformer, one method known to the inventors is to seal the whole transformer in potting material. However, the cost of the method is high, and the volume of the transformer is increased. Moreover, there is a risk of cracking for the potting material when the ambient temperature changes greatly. The second method is to increase the volume of the transformer, and to reduce the electric field strength by increasing the distances between the components of the transformer, which in turn, to control the partial discharge. However, since the number of the transformers in the system is huge, this method notably increases the cost and volume of the transformer, which is undesirable for the improvement of the power density of the system.

The above-described information disclosed in the Background section is to help understand the background of the present disclosure, therefore it may include information that does not constitute a related art known to those of ordinary skill in the art.

SUMMARY

According to one embodiment of the present disclosure, a transformer includes a magnetic core, a first winding and at least one second winding. The magnetic core has a window. The first winding passes through the window of the magnetic core without contacting the magnetic core. The second winding passes through the window of the magnetic core and is wound on the magnetic core. The second winding has a distance from the first winding, and a semi-conductive part is disposed between the second winding and the magnetic core.

DETAILED DESCRIPTION

Figure 1:
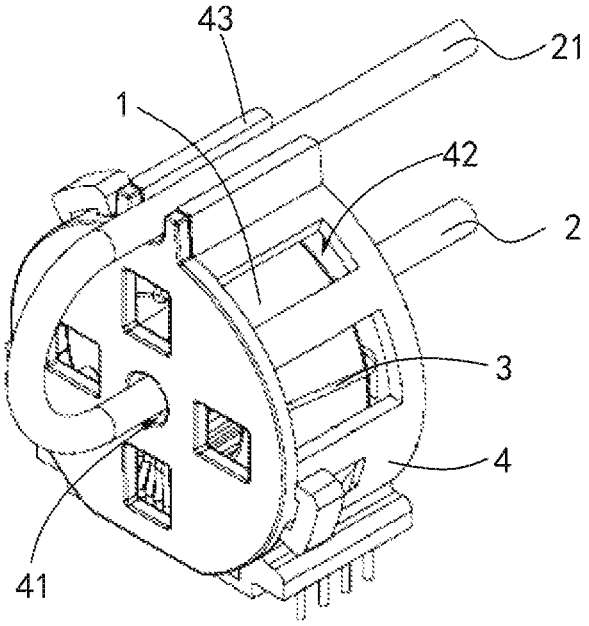
FIG. 1 is a three-dimensional structure diagram of a transformer according to an embodiment of the present disclosure.

The exemplary embodiments will now be described more fully with reference to the accompanying drawings. However, the exemplary embodiments may be embodied in a variety of forms and should not be construed as limited to the embodiments set forth herein. Rather, those embodiments are provided to make the present disclosure to be thorough and complete and to fully convey the concepts of exemplary embodiments to those skilled in the art. The same reference numerals in the drawings denote the same or similar structures, and thus their detailed description will be omitted.

According to one embodiment of the present disclosure, the transformer includes a magnetic core 1, a first winding 2 and at least one second winding 3. The second winding 3 is wound on the magnetic core 1. Partial discharge tends to be generated between the second winding 3 and the magnetic core 1. A semi-conductive part 6 is disposed between the second winding 3 and the magnetic core 1, which reduces the voltage between the second winding 3 and the magnetic core 1, so as to reduce the strength of the electrical field and lower the risk of partial discharge between the second winding 3 and the magnetic core 1. Therefore, the transformer has higher reliability. Components of the present disclosure, such as various windings, may have insulating skin or other insulating structures. The first winding 2 and the second winding 3 may be respectively a primary winding and a secondary winding. However, the present disclosure is not limited thereto.

Figure 2:
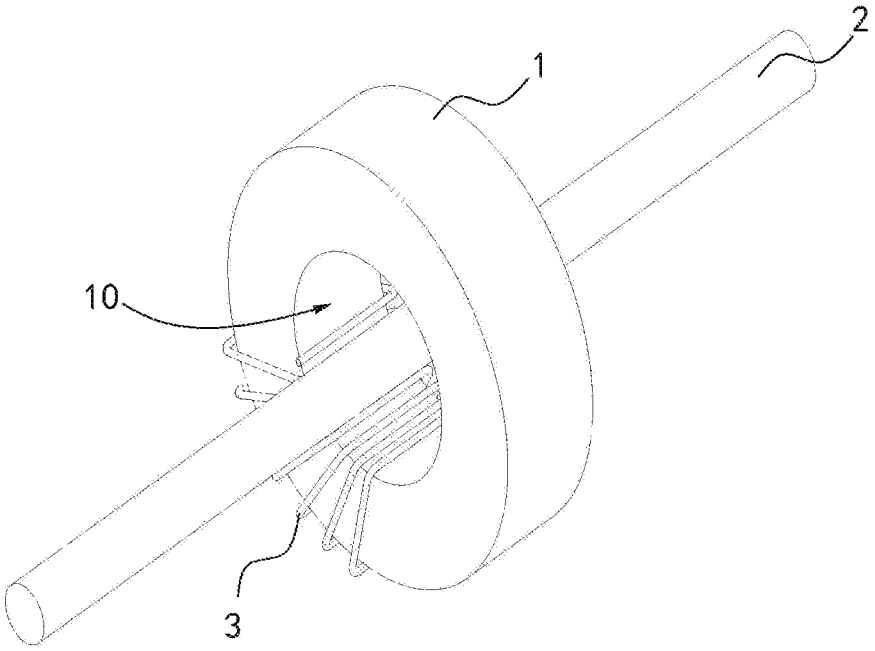
FIG. 2 is a three-dimensional structure diagram illustrating a relationship between a magnetic core and a winding in the transformer as shown in FIG. 1.
Figure 3:
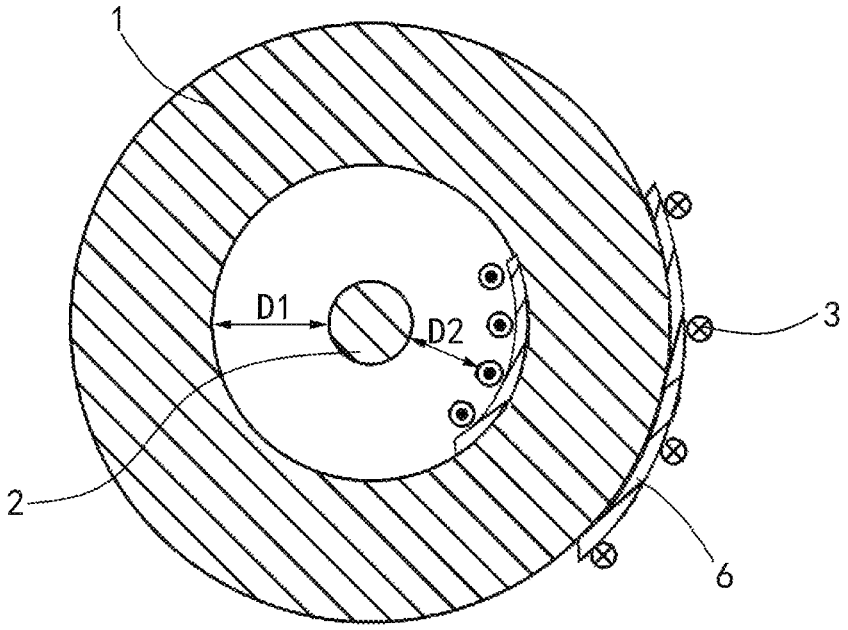
FIG. 3 is a cross sectional view of the transformer as shown in FIG. 2.

Referring to FIG. 1, FIG. 2 and FIG. 3, FIG. 1 is a three-dimensional structure diagram of a transformer according to an embodiment of the present disclosure. FIG. 2 is a three-dimensional structure diagram illustrating a relationship between a magnetic core and a winding in the transformer as shown in FIG. 1. FIG. 3 is a cross sectional view of the transformer as shown in FIG. 2. As shown in FIG. 1, FIG. 2 and FIG. 3, according to an embodiment of the present disclosure, the transformer includes a magnetic core 1, a first winding 2, at least one second winding one or more sets of second windings 3 and a bobbin 4.

As shown in FIG. 1, the bobbin 4 in the transformer of the present disclosure may be a conventional structure and have therein a first holding space 41 and a second holding space 42. The first holding space 41 may be a hole or a cylinder disposed at a central position of the bobbin 4, for example. The second holding space 42 may be an annular groove provided along a circumference direction of the magnetic core 1, for example.

As shown in FIG. 1 and FIG. 2, the magnetic core 1 in the transformer according to the present disclosure may be in an annular form and has a window 10. In other embodiments, the magnetic core 1 may be U shaped or E shaped. Alternatively, the magnetic core 1 may be a combination structure combined by a U-shaped magnetic core and an I-shaped magnetic core, or a combination structure combined by two U-shaped magnetic cores. The present disclosure is not limited thereto, and the structure of the magnetic core is not necessarily a closed structure, and may be an open structure of a single U shaped magnetic core, for example.

As shown in FIG. 2, the first winding 2 in the transformer of the present disclosure may be a high-voltage resistant silicone wire. The first winding 2 perpendicularly passes through the central position of the window 10 of the magnetic core 1. There is a distance D1 between the first winding 2 and the magnetic core 1. That is, the first winding 2 does not contact the magnetic core 1. However, in some other embodiments, the first winding 2 is not necessarily located at the central position of the window 10 of the magnetic core 1, and may be slightly displaced from the central position of the window 10, especially displaced toward a direction away from the second winding 3. In addition, the first winding 2 does not necessarily pass through the window 10 of the magnetic core 1 perpendicularly, and may form an acute angle with the window 10. Particularly in a magnetic core 1 of an irregularly shape, preferably, the first winding 2 passes through the window 10 of the magnetic core 1 obliquely.

As shown in FIG. 2 and FIG. 3, the second winding 3 in the transformer of the present disclosure passes through the window 10 of the magnetic core 1 and is wound on the magnetic core 1. There is a distance D2 between the second winding 3 and the first winding 2. In an embodiment, the second winding 3 may be a triple insulated wire. The second winding 3 includes a forward winding part and a reverse winding part. In other embodiments, the second winding 3 is not limited to the triple insulated wire and the winding direction of the second winding 3 on the magnetic core 1 may also be a single direction, for example totally forward winding or totally reverse winding.

As shown in FIG. 3, in the transformer of the present disclosure, a semi-conductive part 6 is disposed on an outer surface of the second winding 3 which faces the magnetic core 1. The semi-conductive part 6 may be a semi-conductive paint layer. In other embodiments, the semi-conductive part 6 may be a semi-conductive tape, and the like.

Figure 4:
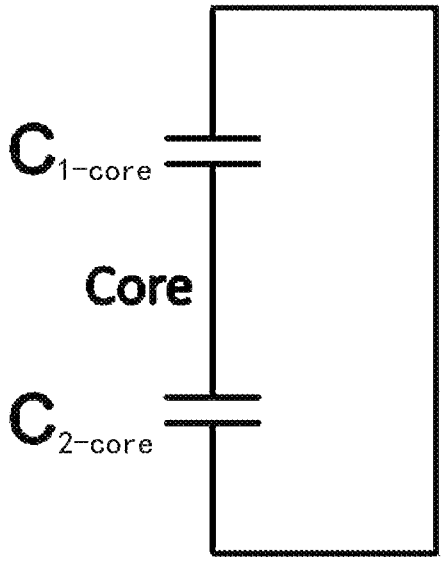
FIG. 4 is a schematic diagram illustrating voltage division of capacitors in the transformer as shown in FIG. 1.

Referring to FIG. 4, FIG. 4 is a schematic diagram illustrating voltage division of capacitors in the transformer as shown in FIG. 1. As shown in FIG. 4, when the second winding 3 is fixed with respect to the position of the magnetic core 1, the maximum strength $E_B$ of the electrical field between the second winding 3 and the magnetic core 1 has the following relationship with the capacitances of the two windings with respect to the magnetic ring:

$$E_B \propto 1+C_{1\text{-}core}/C_{2\text{-}core}$$

Where, $C_{1\text{-}core}$ represents a capacitance of the first winding 2 with respect to the magnetic core 1, and $C_{2\text{-}core}$ represents a capacitance of the second winding 3 with respect to the magnetic core 1. Since a semi-conductive part is disposed between the second winding 3 and the magnetic core 1, for example, by spraying semi-conductive paint, the capacitance $C_{2\text{-}core}$ of the second winding 3 with respect to the magnetic core 1 is increased, thus the strength of the electrical field between the second winding 3 and the magnetic core 1 can be reduced, and the risk of partial discharge between the second winding 3 and the magnetic core 1 can be lowered.

Although the strength of the electrical field between the first winding 2 and the magnetic core 1 is increased, the strength of the electrical field between the first winding 2 and the magnetic core 1 is much smaller than the strength of the electrical field between the second winding 3 and the magnetic core 1, since the distance between the first winding 2 and the magnetic core 1 is much larger than the distance between the second winding 3 and the magnetic core 1. Therefore, it is relatively not so easy to generate partial discharge. The influence of the increase in the strength of the electrical field on the first winding 2 may be neglected. In some embodiments, the first winding 2 may be a high-voltage resistant silicone rubber wire.

In the transformer of the present disclosure, the formation of the semi-conductive part 6 is not limited to the spraying, and other methods are also possible. For example, the semi-conductive part 6 may also be formed on the second winding 3 by dipping, which can simplify the process of forming the semi-conductive part 6. Specifically, when the semi-conductive part 6 is a semi-conductive paint layer, for example, after the second winding 3 of the transformer of the present disclosure is wound on the magnetic core 1, the second winding 3 is baked in the oven with a temperature in a range of 70 to 120° C. for 30 minutes or more, and a part where the second winding 3 contacts the magnetic core 1 is dipped with semi-conductive paint. Then, the first winding 2 is mounted.

Figure 5:
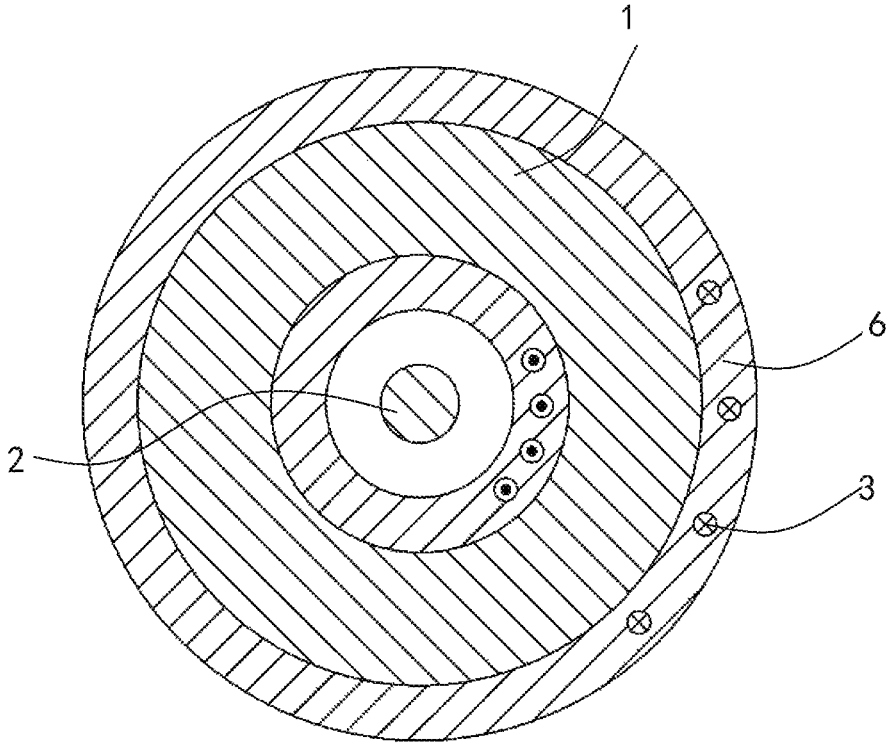
FIG. 5 is a cross sectional view of a transformer according to another embodiment of the present disclosure.

As shown in FIG. 5, when the entire transformer of FIG. 5 is dipped in the paint, that is, when all of the magnetic core 1 and the second winding 3 thereon are dipped in the paint, the semi-conductive part 6 is not only formed on the outer surface of the second winding 3 facing the magnetic core 1, but also covers the outer surface of the second winding 3 which is away from the magnetic core 1, and covers all over the inner surface of the magnetic core 1 at the same time. In the dipping process, while the semi-conductive part 6 is formed, other surfaces of the magnetic core 1 (for example, the outer surface, the upper surface and the lower surface) also have a semi-conductive paint layer formed thereon. Therefore, all of the outer surfaces of the magnetic core 1 are evenly covered by a semi-conductive paint layer. The process can be more easily implemented.

In some other embodiments, only the second winding 3 and the part of the magnetic core where the second winding 3 is disposed are dipped in the semi-conductive paint, other parts of the magnetic core 1 are not dipped in the semi-conductive paint. In this case, only the surface of the second winding 3, the gap between the second winding 3 and the magnetic core 1, and part of the surface of the magnetic core 1 have a semi-conductive paint layer formed thereon, while other parts of the magnetic core 1 have no semi-conductive paint layer formed. For example, in FIG. 1, the first winding 2 is disposed within the first holding space 41, and the magnetic core 1 and the second winding 3 are disposed within the second holding space 42. The first winding 2 also has an extending part 21 which bends and extends from one end of the first winding 2 and is fixed in a holding slot 43 outer side of the bobbin 4. Since the extending part 21 of the first winding 2 is close to the magnetic core 1, if a semi-conductive part 6 is also disposed at a position of the first winding 2 close to the magnetic core 1, it will increase the risk of partial discharge between the extending part 21 and the magnetic core 1.

In some embodiments, the electrical potential of the magnetic core 1 may remain floating. When the electrical potential of the magnetic core 1 remains floating, it may also reduce the strength of the electrical field between the magnetic core 1 and the first winding 2. Comparing with grounding the magnetic core 1, the process is easy to implement.

Figure 6:
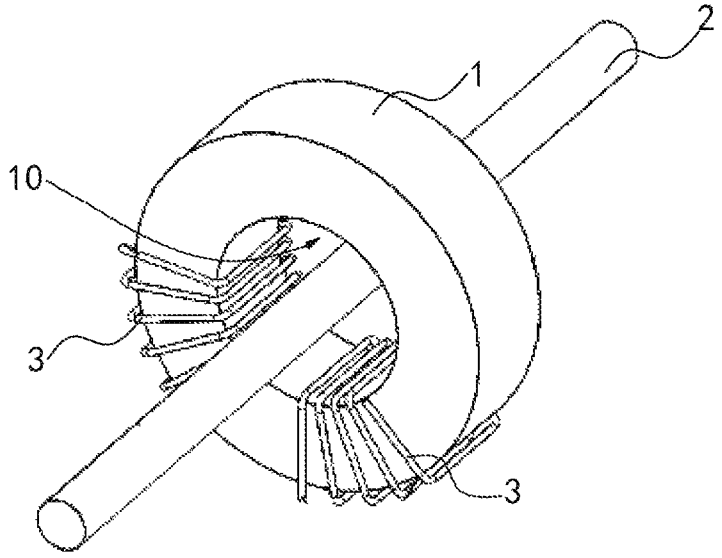
FIG. 6 is a three-dimensional structure diagram of the transformer according to another embodiment of the present disclosure.

Referring to FIG. 6, FIG. 6 is a three-dimensional structure diagram of the transformer according to another embodiment of the present disclosure. In the embodiment as shown in FIG. 6, the transformer includes two second windings 3. The first winding 2 formed by one high-voltage resistant silicone wire passes through the window 10 of the magnetic core 1. The two second windings 3 are wound on the magnetic core 1. The minimum distance between the two second windings 3 is not less than 5 mm. Moreover, each second winding 3 is wound forward for three turns and then wound reversely for two turns, in order to increase the contact area between the second winding 3 and the magnetic core 1, and in turn, to reduce the strength of the electrical field between the second winding 3 and the magnetic core 1.

Figure 7:
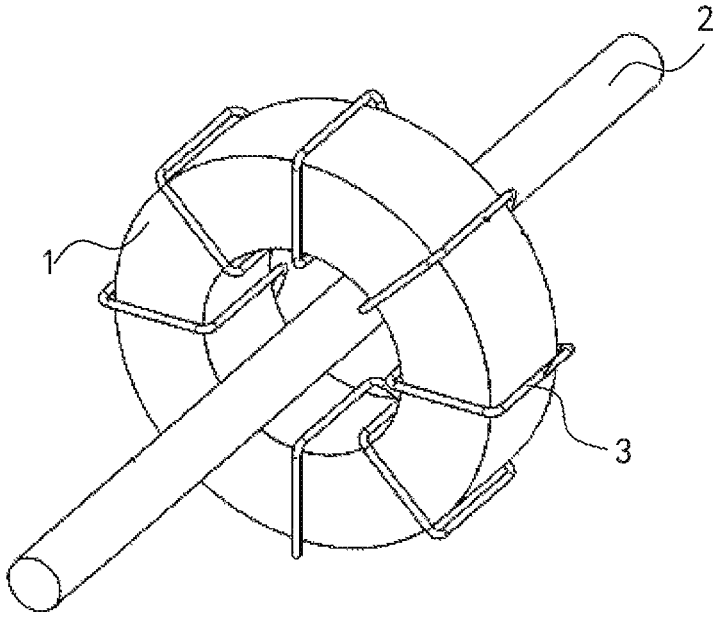
FIG. 7 is a three-dimensional structure diagram of a transformer according to another embodiment of the present disclosure.

Referring to FIG. 7, FIG. 7 is a three-dimensional structure diagram of a transformer according to another embodiment of the present disclosure. In the embodiment of FIG. 7, the transformer includes a second winding 3. The second winding 3 includes a multi-turn coil which uniformly distribute on the magnetic core 1. Other structures of the transformer as shown in FIG. 7 are substantially the same as the embodiment as shown in FIG. 6, which will not be repeated herein.

In other embodiments, in any of the above transformers, the surface of the second winding 3 facing the first winding 2 may be further provided with an insulating part. For example, in a dipping process, after the dipping of semi-conductive paint is completed, the whole product may be dipped with silicone rubber paint. Alternatively, part of the second winding 3 is dipped with silicone rubber paint. That is, the outer surface of the second winding 3 facing the first winding 2 may have an insulating part formed of silicone rubber paint. This increases the insulation performance between the first winding 2 and the second winding 3. The compound processes may reduce the strength of the electrical field between the first winding 2 and the second winding 3 as well as the strength of the electrical field between the second winding 3 and the magnetic core 1 of the transformer. It can significantly lower the risk of partial discharge between the components of the transformer and improve the reliability of the transformer. In other embodiments, the silicone rubber paint may also be replaced with insulating material such as silicone gel and the like, and the dipping process may be replaced by spraying and the like, as long as the outer surface of the second winding 3 facing the first winding 2 may have an insulating part formed.

The relative terms, such as "up" or "down", may be used in the above embodiments to describe the relative relationship of one element to another element as illustrated. It is to be understood that if the device as illustrated is turned upside down, the elements described as "upper" will become "under". The terms "a", "an", "the" and "at least one" are used to indicate the presence of one or more elements/components/etc. The terms "include", "comprise" and "have" are used to denote the open-ended meanings and mean additional components that may be present in addition to the listed components. "First" or "second" is used only as a reference, not a digital limit on its object.

It is to be understood that this disclosure does not limit its application to the detailed construction and arrangement of the components set forth herein. The present disclosure can have other embodiments and can be implemented and executed in a number of ways. The foregoing variations and modifications are within the scope of the present disclosure. It is to be understood that the present disclosure disclosed and limited herein extends to all alternative combinations of two or more separate features mentioned or apparent in the text and/or in the drawings. All of these different combinations constitute a number of alternative aspects of the present disclosure. The embodiments described herein illustrate the best way known for carrying out the present disclosure and will enable those skilled in the art to utilize the present disclosure.

What is claimed is:

1. A transformer comprising:

a magnetic core having a window;

a first winding passing through the window of the magnetic core without contacting the magnetic core; and at least one second winding passing through the window of the magnetic core, wherein the second winding is wound on the magnetic core, and has an outer surface and an inner surface, wherein the second winding has a distance from the first winding, an electric potential of the magnetic core is floating, a distance between the first winding and the magnetic core is larger than a distance between the second winding and the magnetic core, and a semi-conductive part is disposed between the inner surface of the second winding and the magnetic core to increase capacitance of the second winding with respect to the magnetic core, so as to reduce strength of electrical field between the second winding and the magnetic core, so as to lower risk of partial discharge between the second winding and the magnetic core.

2. The transformer of claim 1, wherein the semi-conductive part is formed between the second winding and the magnetic core by dipping or spraying.

3. The transformer of claim 1, wherein the semi-conductive part is a semi-conductive tape or a semi-conductive paint layer.

4. The transformer of claim 1, wherein the first winding is a silicone wire.

5. The transformer of claim 1, wherein the second winding is a triple insulated wire.

6. The transformer of claim 1, wherein the magnetic core is in an annular shape.

7. The transformer of claim 6, wherein the first winding perpendicularly passes through a central position of the window of the magnetic core.

8. The transformer of claim 1, further comprising:

a bobbin having a first holding space and a second holding space therein, wherein the first winding is disposed within the first holding space, and the magnetic core and the second winding are disposed within the second holding space.

9. The transformer of claim 8, wherein the first winding further has an extending part, and the extending part bends and extends from one end of the first winding and is fixed outer side of the bobbin.

10. The transformer of claim 1, wherein an insulating part is disposed on the outer surface of the second winding facing the first winding.

11. The transformer of claim 1, wherein the second winding comprises a winding part having a first winding direction and a winding part having a second winding direction, and the first winding direction is opposite to the second winding direction.

12. The transformer of claim 1, wherein the second winding comprises a multi-turn coil, and the multi-turn coil is uniformly distributed on the magnetic core.

* * * * *